United States Patent [19]

Movilliat et al.

[11] Patent Number: 4,875,679

[45] Date of Patent: Oct. 24, 1989

[54] TENNIS RACKET

[75] Inventors: Pierre A. Movilliat; Yves Piegay; Gilles D. Gardin, all of Voiron, France

[73] Assignee: Societe SKIS ROSSIGNOL S.A., Voiron, France

[21] Appl. No.: 134,148

[22] Filed: Dec. 17, 1987

[30] Foreign Application Priority Data

Dec. 22, 1986 [FR] France ..... 86 18458

[51] Int. Cl.[4] ..... A63B 49/02

[52] U.S. Cl. ..... 273/73 R; 273/73 C; 273/73 J

[58] Field of Search ..... 273/73 R, 73 C, 73 D, 273/73 J, 73 F, 73 H, 73 G

[56] References Cited

U.S. PATENT DOCUMENTS

| | | | |
|---|---|---|---|
| 4,044,625 | 8/1977 | D'Haem et al. | 273/73 J X |
| 4,181,301 | 1/1980 | Cholat-Serpoud et al. | 273/73 C |
| 4,278,251 | 7/1981 | Lafourcade | 273/73 C |
| 4,627,635 | 12/1986 | Koleda | 273/73 J X |
| 4,660,832 | 4/1987 | Shomo | 273/73 J |
| 4,736,949 | 4/1988 | Muroi | 273/73 J |
| 4,811,947 | 3/1989 | Takatsuka et al. | 273/73 J |

OTHER PUBLICATIONS

Brody, Howard "The Science of Winning Tennis", Aug. 16, 1987, p. D3.

*Primary Examiner*—Edward M. Coven
*Assistant Examiner*—William E. Stoll
*Attorney, Agent, or Firm*—Browdy and Neimark

[57] ABSTRACT

A tennis racket provided with a vibration damping device. The racket includes at least one pair of viscoelastic dampers, symmetric relative to a longitudinal axis of the racket and working in opposition. Each damper of the pair consists of a plate of viscoelastic material, whose one face is glued against the racket at a selected spot of the racket, and which includes on its other face a stress plate of rigid material. The selected spot corresponds to the antinode of a specific mode of vibration of the racket.

21 Claims, 3 Drawing Sheets

TENNIS RACKET

BACKGROUND OF THE INVENTION

This invention relates to a ball game racket, more particularly intended for tennis, this racket being provided with a device for damping vibrations.

The playing qualities of a racket are determined by a rather large number of criteria which, in general, can be classified into two categories:

- performance criteria: efficiency, snappiness, stiffness, etc.
- criteria of comfort for the player: gentleness, handling ability, etc.

However, some criteria, for example tolerance of off-centering of the ball impact, can fall into both categories.

These two categories of criteria are most often contradictory, so that, most of the time, comfort can be improved only at the expense of performance and vice versa.

It is known that a system subjected to a disturbance vibrates around one or more proper frequencies which are characteristic of the structure and result from its distribution of mass and stiffness. The behavior resulting from this set of vibrations is the sum of the displacements which are generated, in various directions, by the resonance frequencies of this structure. These displacements are minimal at the spots currently called vibration "nodes" and maximum at the spots currently called vibration "antinodes."

This vibratory behavior would be infinite in the absence of any damping property of the structure. In a general way, any physical system is subjected to one or more types of damping as long as energy is dispersed either by friction or by other dissipating systems, for example viscoelastic or hysteresis systems.

It was noted that in the case of the tennis player, the vibrations which are transmitted to him by his racket after impact of the ball are directly correlated with his perception of the behavior of his device. In the range of frequencies going from 0 to 1000 Hz, a range in which man is greatly receptive to the vibrations, tennis rackets vibrate in several directions and frequencies, which correspond to what will be called below "proper vibratory modes." It was possible to show seven proper vibratory modes closely correlated with the behavior of the racket in play:

- three located in a direction perpendicular to the plane of the racket; they are the simple bending modes perpendicular to the median longitudinal plane of the racket;
- two located in the plane of the racket; they are the lateral bending modes; and
- two others which are couplings between vibrations of bending perpendicular to the median longitudinal plane of the racket and of twisting relative to its median longitudinal axis.

By way of illustration, some of these vibratory modes are represented diagrammatically on the accompanying drawings in FIGS. 1–5.

The proper vibratory modes on which it is most important to act are, of course, the modes of greater energy, i.e., those that generate considerable deformations of the structure.

Therefore, it is advisable as a matter of priority to influence the three first modes of bending which are perpendicular to the plane of the racket, the two first modes of bending which are in the plane of the racket, as well as the first mode of coupling of the vibrations of bending which are perpendicular to the plane of the racket and twisting relative to its longitudinal axis.

It is already known, to adjust the playing qualities, to provide on the tennis racket relatively complex means to damp the vibrations. Thus it is known to add damping elements, which are relatively complex and bulky, at selected spots on the racket frame.

SUMMARY OF INVENTION

By simple and inexpensive means, the invention aims at selectively adjusting the damping of a tennis racket by applying to it, at determined spots, a damping element whose damping factor is found to be optimal in the operating temperature and frequency range of the racket. Therefore it relates to a ball game racket, more particularly intended for tennis, of the type comprising at least one vibration damping element which is locally positioned on the racket, on a relatively small surface and in a determined zone or zones of the racket. This vibration damping element consists, on the one hand, of a plate of viscoelastic material whose damping factor is at least 0.5 in an operating range spreading in temperature from 10° to 30° C. and in frequency from 0 to 1000 Hz and, on the other hand, of a stress plate whose modulus is very high relative to that of the viscoelastic material, the plate of viscoelastic material being glued between the racket and stress plate. Advantageously, the thickness of the plate of viscoelastic material is between 0.5 and 1.2 mm, the damping factor of this viscoelastic material is between 0.8 and 1.2 and the thickness of the stress plate is between 0.5 and 1.2 mm.

For example, each damper comprises a stress plate of ZICRAL, an aluminum alloy, international reference 7075 having a thickness of 0.6 mm, which is glued to a sheet of viscoelastic material having a thickness of 0.8 mm, and of a damping factor, generally called beta, on the order of 1.2, optimal in a temperature range between 10° and 30° C. and for vibration frequencies between 10 and 1000 Hz.

Therefore, this racket can comprise at least one viscoelastic damper, working with shearing, which is placed in the zone where the viscoelastic material between the racket and the ZICRAL stress plate is most deformed by shearing stress. It thus absorbs and dissipates a large amount of energy which is not returned to the structure. The vibration effect is then modified by reducing the displacement amplitude of the structure.

To make the racket according to the present invention, the damper or dampers, optionally connected, is or are placed on the bridge, on the branches, on the sides of the branches, or on any other part of the racket located in the zones able to provide great energy to the viscoelastic material constituting the lower part of the damping element.

Depending on its position on the racket, the damper reduces the amplitude of certain vibratory modes, which causes a modification of the player's sensations. Thus, to damp the amplitude of the first vibration mode for bending perpendicular to the plane of the racket, the damping system is placed on the outside and/or inside face of the branches of the racket, from the front part of the handle to the footing of the bridge. Then, the racket is felt to be more flexible, with a longer contact with the ball.

By positioning the damping system on the bridge or on both sides of the bridge and/or on the head or on both sides of the head of the frame, symmetrically relative both to the longitudinal axis of the racket and/or to the plane of the racket, both the amplitude of the second and third vibration modes of bending perpendicular to the median plane of the racket and the amplitude of the first vibration mode coupling the bending perpendicular to the median plane and the twisting relative to the median longitudinal axis of the racket are damped. The racket appears to be snappier and performance is thus improved. For reasons of decoration, these strictly symmetrical shapes can be slightly modified.

By positioning the damping system on the faces of the frame, coupled in pairs, symmetrically both relative to the median longitudinal plane of the racket and relative to the nodal line of the first mode of bending perpendicular to the plane of the racket, preferably the amplitude of the vibration of these modes in the zone of the frame is damped. The racket then appears more stable at the moment of impact between the ball and the strings.

BRIEF DESCRIPTION OF THE DRAWING

In any case, the invention will be better understood and its advantages and other characteristics will come out during the following description of some nonlimiting examples of this racket, with reference to the accompanying drawings in which.

DETAILED DESCRIPTION OF PREFERRED EMBODIMENTS

Figure 1:
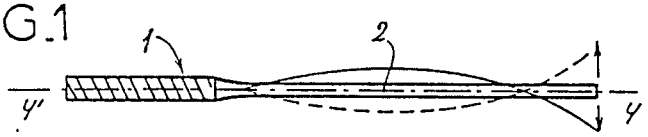
FIG. 1 illustrates the first proper vibratory mode of a tennis racket.
Figure 2:
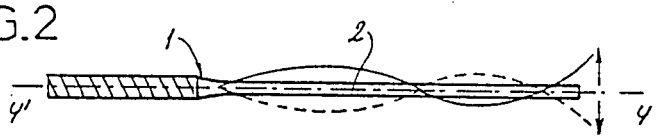
FIG. 2 illustrates the second proper vibratory mode of a tennis racket.
Figure 3:
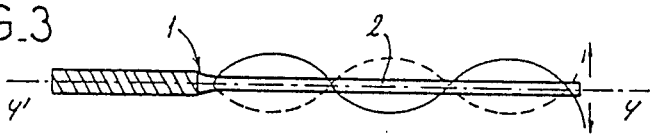
FIG. 3 illustrates the third proper vibratory mode of a tennis racket.
Figure 4:
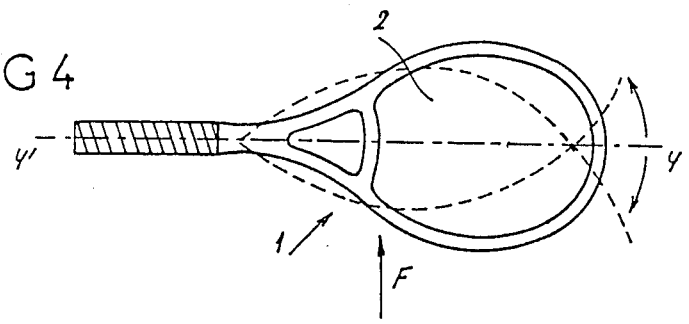
FIG. 4 illustrates a lateral view of the first proper vibratory mode of lateral bending of a tennis racket.
Figure 5:
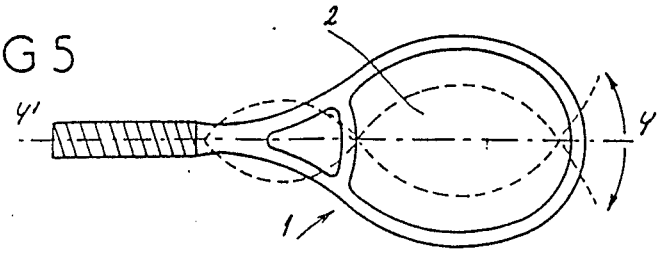
FIG. 5 illustrates a lateral view of the second proper vibratory mode of lateral bending of a tennis racket.
Figure 6:
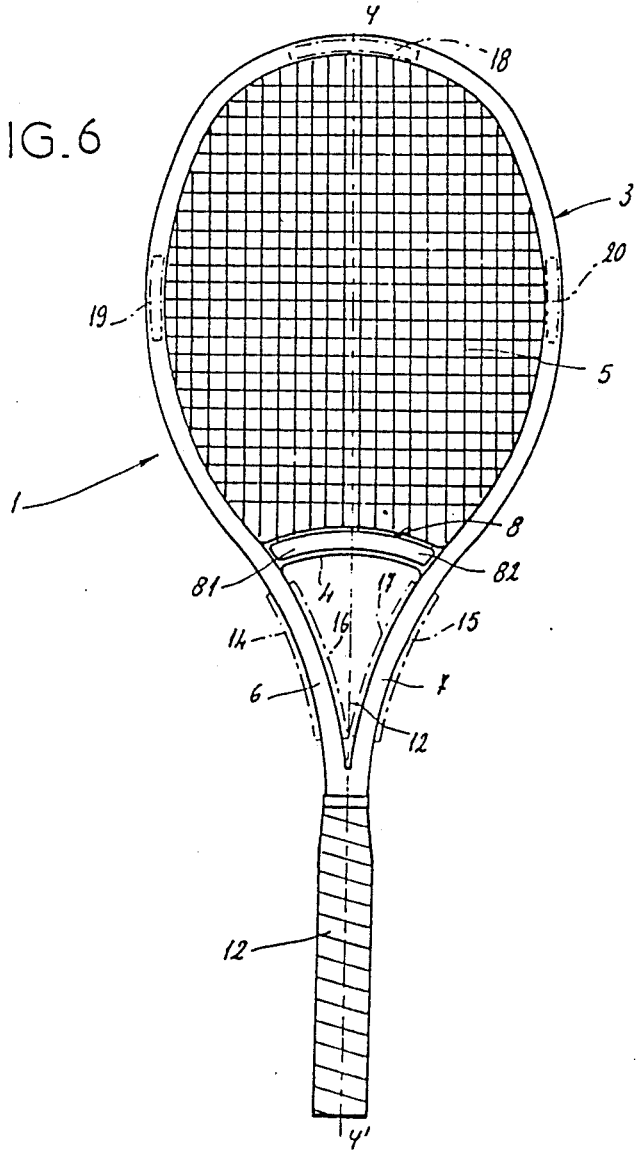
FIG. 6 is plan view of the racket.

Referring to FIG. 6, the tennis racket 1 is made up of a handle 12 extended by two branches 6, 7 which carry frame 3, whose lower part forms bridge 4. Frame 3 itself carries face 5 made up of longitudinal and crosswise strings and forming the striking surface.

Figure 7:
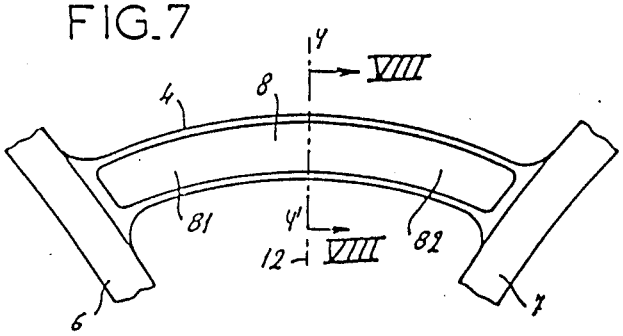
FIG. 7 is an enlarged view of the bridge of the racket.
Figure 8:
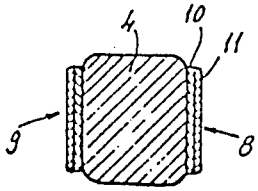
FIG. 8 is a view in section along VIII—VIII of FIG. 7.

As can be seen better in FIGS. 7 and 8, a pair of identical viscoelastic dampers 8, 9 have been fixed by gluing on the two faces of bridge 4 which are parallel to the plane of racket 1. Each of these two dampers, for example damper 8, is made up of a plate 10 of viscoelastic material to which is glued a stress plate 11, of ZICRAL for example. Each damper, such as 8, is glued flat on bridge 4 by the face of plate 10 which is opposite stress plate 11.

Plates 10 and 11 have the same shape and dimensions and their periphery fits that of the surface of bridge 4 to which plate 10 is glued, being slightly smaller than the surface. The thickness of plate 10 is 0.8 mm and its damping factor beta is 1.2 in the temperature range between 10° and 30° C., which is the range of most frequent use of the racket. ZICRAL stress plate 11 has a thickness of 0.6 mm. Each damper, 8 or 9, is totally symmetrical relative to longitudinal axis y'y of the racket and can therefore be considered as made up of a couple of dampers 81, 82 symmetrical relative to this axis y'y and working with shearing and in opposition. In this present case, there are a couple of dampers 8, 9, each placed on either side of the bridge.

With this arrangement, each pair of dampers 81, 82 damps the vibratory modes which arise in the plane of the racket, which increases the player's comfort.

The invention obviously is not limited to this embodiment. It is possible to provide, besides dampers 8, 9 or instead of them, similar dampers 14, 15, 16, 17 glued, preferably symmetrically relative to axis y'y, on the outside and/or inside lateral faces of the two branches 6, 7 (shown in dotted lines in FIG. 6). These dampers 14 to 17 damp the vibratory modes perpendicular to the plane of the racket, which tends to improve the performance. It is also possible to provide, alone or combined with others at other spots, dampers 18 added to the head of frame 3, and/or dampers 19, 20 added to frame 3, for example in its middle, on both sides of axis y'y (shown in dotted lines in FIG. 6). In each case, instead of having pairs of coupled dampers 8, 9, on each face of the racket, it is possible to have only one damper on a single face, for example damper 8 only and not damper 9. Only symmetry relative to axis y'y is preferred. This racket therefore can comprise, by way of preferred examples:

- at least one damping element 8 and/or 9 fastened to bridge 4 of racket 1,
- two damping elements 8 and 9 coupled and fastened on both sides of bridge 4,
- at least one damping element 18 and/or 19 and/or 20 fastened to frame 3,
- at least a damping element 18 fastened to the head of frame 3,
- two damping elements 18 coupled and fastened to the head of frame 3 on both sides of plane 2 of the frame,
- at least two damping elements 19, 20 coupled and fastened to frame 3 on both sides of longitudinal axis y'y of the racket,
- four dampers 19, 20 coupled and fastened to frame 3 on both sides of its plane 2 as well as its longitudinal axis y'y,
- at least one damping element 14 and/or 15 and/or 16 and/or 17 fastened to the inside or outside of a branch 6 and/or 7 of the racket,
- two damping elements 16 and 17 coupled and fastened to the inside of two branches 6, 7,
- two damping elements 14 and 15 coupled and fastened to the outside of two branches 6, 7,
- four damping elements 14 to 17 coupled and fastened to the inside or outside of the two branches 6, 7,
- or another combination in positions and dimensions of these damping elements.

A racket 1 was described with an inverted bridge 4, but this racket can be of any other type, for example, with a bridge perpendicular to axis y'y, with a bridge with a curve opposite that of the frame head, with a bridge exhibiting two opposite curves in the opposite direction, etc.

What is claimed is:

1. A ball game racket comprising at least one vibration damping element added to the structure of the racket, said vibration damping element positioned locally on the racket on a relatively small surface of the racket and in at least one predetermined zone of the racket;

said element being of the stress plate type associated with a viscoelastic material intended to be shear-stressed and mounted integrally on the outside of the racket wherein each damping system consists of a plate made of a first material and a second material;

said first material being a viscoelastic material having a damping coefficient of at least 0.5 in a temperature range of from 10° to 30° C. and for frequencies ranging from 0 to 1000 Hz;

said first material glued by vulcanization onto a rigid plate forming said second material;

said second material having a modulus which is very high relative to that of the viscoelastic material;

said plate located at the maximum of the zone of curvature corresponding to one of the three first vibratory modes of bending of the racket.

2. The racket according to claim 1, wherein the thickness of the plate of viscoelastic material is between 0.5 and 1.2 mm, the damping factor, beta, of the viscoelastic material is between 0.8 and 1.2, and the thickness of the stress plate is between 0.5 and 1.2 mm.

3. The racket according to claim 1, wherein the thickness of the plate of viscoelastic material is on the order of 0.8 mm, and the damping factor, beta, is on the order of 1.2.

4. The racket according to claim 3, wherein the stress plate is constructed of ZICRAL and has a thickness on the order of 0.6 mm.

5. The racket according to claim 1, wherein the racket comprises a bridge, and the at least one damping element is fastened to the bridge.

6. The racket according to claim 5, wherein the racket comprises two damping elements coupled and fastened on both sides of the bridge.

7. The racket according to claim 1, wherein the racket comprises a frame and the at least one damping element is fastened to the frame.

8. The racket according to claim 7, wherein the racket comprises at least one damping element fastened to a head portion of the frame.

9. The racket according to claim 8, wherein the racket comprises two damping elements coupled and fastened to the head of the frame on both sides of a predetermined plane of the frame.

10. The racket according to claim 7, wherein the racket comprises at least two damping elements coupled and fastened to the frame on both sides of a longitudinal axis (y'y) of the racket.

11. The racket according to claim 10, wherein the racket comprises four dampers coupled and fastened to the frame on both sides of a plane of the frame and a longitudinal axis (y'y) thereof.

12. The racket according to claim 1, wherein the racket comprises at least one damping element fastened on an inside or outside portion of a branch of the racket.

13. The racket according to claim 12, wherein the racket comprises two damping elements coupled and fastened on the inside of two branches of the racket.

14. The racket according to claim 12, wherein the racket comprises two damping elements coupled and fastened on the outside of two branches of the racket.

15. The racket according to claim 12, wherein the racket comprises four damping elements coupled and fastened on the inside and outside of two branches of the racket.

16. A racket according to claim 1 wherein said damping system is placed at the maximum of the zone of curvature corresponding to the first vibratory mode of bending perpendicular to the plane of the racket.

17. A racket according to claim 1 wherein said damping system is placed at the maximum of the zone of curvature corresponding to the second vibratory mode of bending perpendicular to the plane of the racket.

18. A racket according to claim 1 wherein said damping system is placed at the maximum of the zone of curvature corresponding to the third vibratory mode of bending perpendicular to the plane of the racket.

19. A racket according to claim 1 wherein said damping system is placed at the maximum of the zone of curvature corresponding to the first vibratory mode of lateral bending of the racket.

20. A racket according to claim 1 wherein said damping system is placed at the maximum of the zone of curvature corresponding to the second vibratory mode of lateral bending of the racket.

21. A racket according to claim 1 wherein said damping system is placed at the maximum of the zone of curvature corresponding to the first vibratory mode of coupling of vibrations of bending perpendicular to the plane of the racket and of torsion relative to the longitudinal axis of the racket.

* * * * *